United States Patent [19]

Mai et al.

[11] Patent Number: 4,839,929

[45] Date of Patent: Jun. 20, 1989

[54] AUXILIARY TOILET SEAT

[76] Inventors: M. Jane Mai, 10704 W. 108th Ter., Overland Park, Kans. 66210; Maxine Hargrave, 802 N. State St., Jerseyville, Ill. 62052

[21] Appl. No.: 170,007

[22] Filed: Mar. 18, 1988

[51] Int. Cl.[4] ..... A47K 13/00

[52] U.S. Cl. ..... 4/254; 4/239; 4/240; 4/247

[58] Field of Search ..... 4/234–236, 4/241–247, 237, 238, 239, 240, 251, 254; 297/192, 193

[56] References Cited

U.S. PATENT DOCUMENTS

| | | | |
|---|---|---|---|
| 1,308,406 | 7/1919 | Engleman | 4/247 |
| 1,363,085 | 12/1920 | Carlson | 4/247 |
| 1,752,499 | 4/1930 | Meath . | |
| 2,392,544 | 1/1946 | Nyberg . | |
| 2,598,577 | 5/1952 | Mattison | 4/237 |
| 2,645,784 | 7/1953 | Blackburn . | |
| 2,834,028 | 5/1958 | Stanley | 4/254 |
| 3,860,970 | 1/1975 | Thompson | 4/239 |
| 4,030,146 | 6/1977 | Pillington et al. | 4/251 |
| 4,534,072 | 8/1985 | Lipski . | |
| 4,592,097 | 6/1986 | Zimmerman | 4/251 |
| 4,635,303 | 1/1987 | Shih . | |

FOREIGN PATENT DOCUMENTS

| | | | |
|---|---|---|---|
| 286377 | 8/1915 | Fed. Rep. of Germany | 4/247 |
| 104482 | 3/1917 | United Kingdom | 4/247 |

*Primary Examiner*—Harvey C. Hornsby
*Assistant Examiner*—Joseph S. Machuga
*Attorney, Agent, or Firm*—Jerry T. Kearns

[57] ABSTRACT

An auxiliary toilet seat has a bench type seat supported by two vertical legs. Horizontal mounting flanges on the lower ends of each vertical leg are utilized to permanently attach the auxiliary toilet seat in front of a conventional toilet in a public rest room. The bench type seat is connected by a hinge to a top end of one of the vertical legs. The bench seat may be swung between open and closed positions, to provide access to the toilet. In use, an individual sits on the auxiliary bench seat while utilizing the toilet. This provides protection against acquiring communicable diseases while utilizing conventional public toilet seats. In a second embodiment of the present invention, the vertical legs provide a cantilever support for attachment to existing toilet mounting bolts. This construction does not require the drilling of any additional holes in the floor of the public rest room. A tissue roll holder is positioned adjacent one end of the bench seat and allows the seat to be covered with clean tissue paper after each use.

3 Claims, 5 Drawing Sheets

AUXILIARY TOILET SEAT

BACKGROUND OF THE INVENTION

1. Field of the Invention

The present invention relates to toilet seats, and more particularly pertains to an auxiliary toilet seat for providing protection from contracting disease from public toilet seats. Because of the awareness and publicity concerning venereal diseases, AIDS, and herpes, the public (particularly women) has become increasingly concerned with the possibility of contracting these diseases from the use of public toilets. Therefore, a large percentage of women try to stand up while going to the bathroom. This is very difficult to do and maintain your balance at the same time. Also, these contortions result in the soiling of the existing toilet seats, making it impossible for the next person to use the toilet in a seated position. Therefore, the present invention provides an auxiliary toilet seat which enables an individual to utilize a public toilet without contacting the toilet seat with any open part of their body.

2. Description of the Prior Art

Various types of toilet seats are known in the prior art. A typical example of such a toilet seat is to be found in U S. Pat. No. 1,752,499, which issued to C. Meath on Apr. 1, 1930. This patent discloses an auxiliary child seat which overlies an existing toilet seat. The child seat is pivotal between storage and in use positions, to enable the toilet to be selectively utilized by either adults or children. U.S. Pat. No. 2,392,544, which issued to W. Nyberg on Jan. 8, 1946, discloses a foldable portable infant seat for attachment to conventional toilet seats. This device utilizes spring clips for engagement with the conventional seat. U.S. Pat. No. 2,645,784, which issued to R. Blackburn on July 21, 1953, discloses a toilet seat which has a selectively pivotal portion which, in a lowered position, forms a seat for an adult and which, in a raised position, forms a child seat with a back rest having arm supports for use by children. U.S. Pat. No. 4,534,072, which issued to M. Lipski on Aug. 13, 1985, discloses an auxiliary toilet seat to enable small children to sit safely on top of a toilet. This device comprises two vertical legs which support a seat slightly above the height of a standard toilet bowl. The device also provides a step to enable children to climb up to the seat. U.S. Pat. No. 4,635,303, which issued to P. Shih on Jan. 13, 1987, discloses a foldable toilet seat for use by children. The invention comprises a child size seat having attached foldable hand rails and a step. When not in use, the child seat and attached hand rails and step fold to a compact vertical storage position.

While the above mentioned devices are suited for their intended usage, none of these devices provide an auxiliary bench type seat which enables individuals to utilize public toilets while contacting the seat only with the back of their upper legs. Additionally, none of the aforesaid devices provide an auxiliary toilet seat having cantilever supporting legs for attachment to existing toilet mounting bolts. Inasmuch as the art is relatively crowded with respect to these various types of toilet seats, it can be appreciated that there is a continuing need for and interest in improvements to such toilet seats, and in this respect, the present invention addresses this need and interest.

SUMMARY OF THE INVENTION

In view of the foregoing disadvantages inherent in the known types of toilet seats now present in the prior art, the present invention provides an improved auxiliary toilet seat. As such, the general purpose of the present invention, which will be described subsequently in greater detail, is to provide a new and improved auxiliary toilet seat which has all the advantages of the prior art toilet seats and none of the disadvantages.

To attain this, representative embodiments of the concepts of the present invention are illustrated in the drawings and make use of a bench type seat supported by two vertical legs. Horizontal mounting flanges on the lower ends of each vertical leg are utilized to permanently attach the auxiliary toilet seat in front of a conventional toilet in a public rest room. The bench type seat is connected by a hinge to a top end of one of the vertical legs. The bench seat may be swung between open and closed positions, to provide access to the toilet. In use, an individual sits on the auxiliary bench seat while utilizing the toilet. This provides enhanced protection against acquiring disease while utilizing conventional public toilet seats. In a second embodiment of the present invention, the vertical legs provide a cantilever support for attachment to existing toilet mounting bolts. This construction does not require the drilling of any additional holes in the floor of the public rest room. A tissue roll holder is positioned adjacent one end of the bench seat and allows the seat to be covered with clean tissue paper after each use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved auxiliary toilet seat which has all the advantages of the prior art toilet seats and none of the disadvantages.

It is another object of the present invention to provide a new and improved auxiliary toilet seat which may be easily and efficiently manufactured and marketed.

It is a further object of the present invention to provide a new and improved auxiliary toilet seat which is of a durable and reliable construction.

An even further object of the present invention is to provide a new and improved auxiliary toilet seat which is susceptible of a low cost of manufacture with regard to both materials and labor, and which accordingly is then susceptible of low prices of sale to the consuming public, thereby making such toilet seats economically available to the buying public.

Still yet another object of the present invention is to provide a new and improved auxiliary toilet seat which provides in the apparatuses and methods of the prior art some of the advantages thereof, while simultaneously overcoming some of the disadvantages normally associated therewith.

Still another object of the present invention is to provide a new and improved auxiliary toilet seat which enables individuals to utilize public toilets without fear of contracting diseases.

Yet another object of the present invention is to provide a new and improved auxiliary toilet seat which utilizes a bench type seat pivotal between a horizontal closed position and a vertical open position for providing access to a conventional public toilet.

Even still another object of the present invention is to provide a new and improved auxiliary toilet seat which utilizes cantilever vertical supporting legs for attaching a pivotal bench type seat to existing toilet mounting bolts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
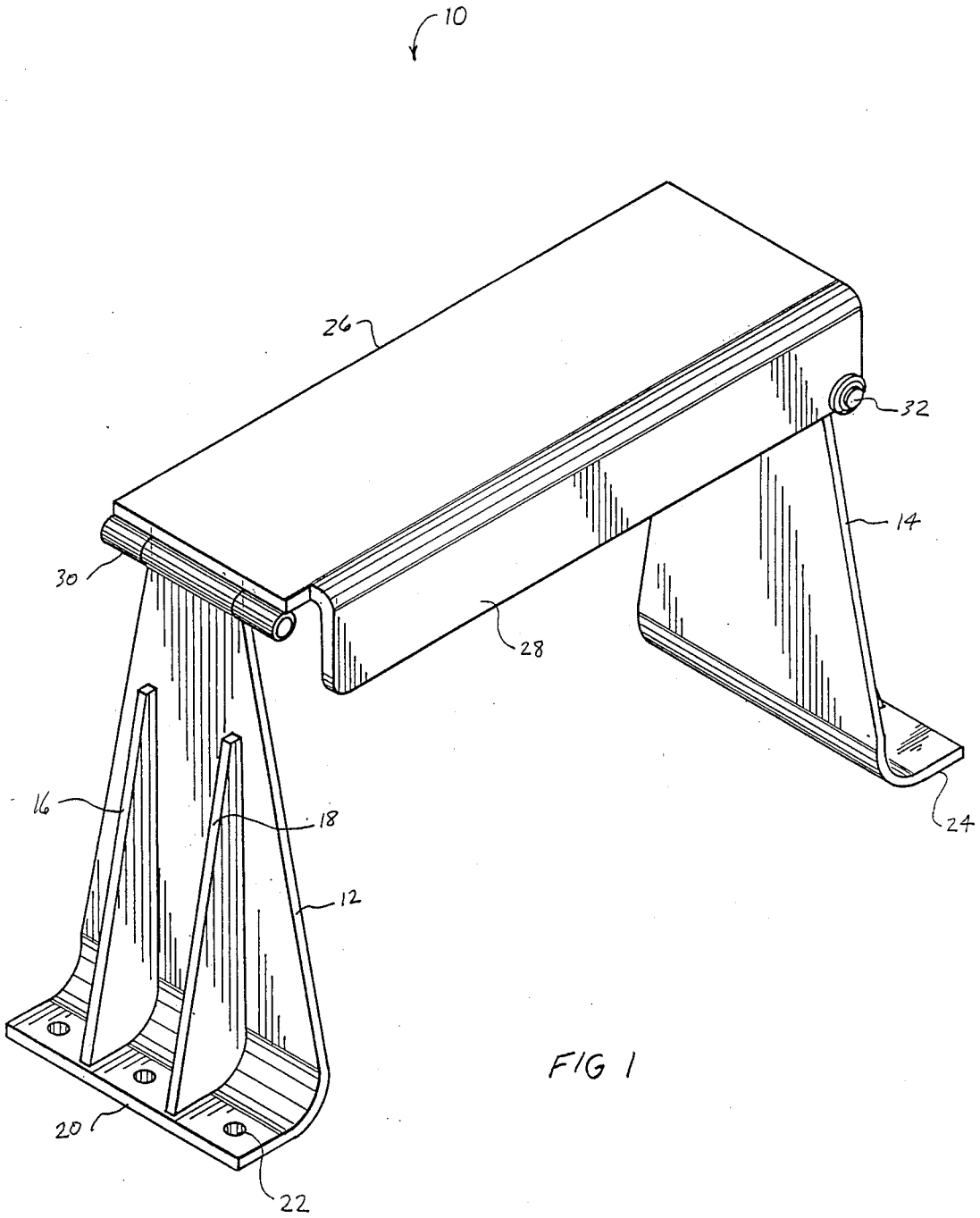
FIG. 1 is a perspective view of the auxiliary toilet seat according to the first embodiment of the present invention.

With reference now to the drawings, and in particular to FIG. 1 thereof, a new and improved auxiliary toilet seat embodying the principles and concepts of the present invention and generally designated by the reference numeral 10 will be described.

More specifically, it will be noted that the first embodiment 10 of the invention includes a first vertical leg 12 and a second vertical leg 14. A pair of generally triangular support ribs 16 and 18 on the vertical leg 12 provide enhanced rigidity. The legs 12 and 14 terminate in horizontally extending mounting flanges 20 and 24. The mounting flange 20 is provided with a plurality of spaced apertures 22 for the reception of conventional threaded fasteners to be utilized in securing the auxiliary toilet seat 10 to the floor of a public rest room, adjacent a conventional toilet seat. A bench type seat 26 has a downwardly extending front wall portion 28. The bench type seat is connected by a hinge 30 to the top portion of the leg 12. The opposite end of the seat 26 rests on the top portion of the leg 14. A handle 32 is provided for manually raising the seat 26 to a vertical position, to gain access to the toilet.

Figure 2:
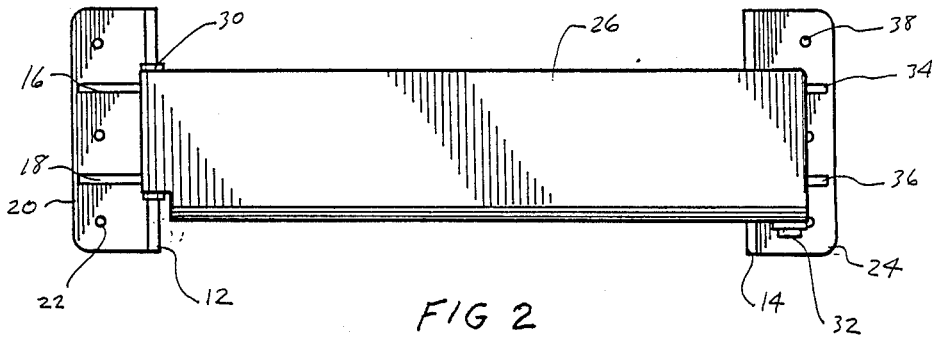
FIG. 2 is a top view of the auxiliary toilet seat according to the first embodiment of the present invention.

As shown in the top view of FIG. 2, the vertical support leg 14 is also provided with a pair of generally triangular support ribs 34 and 36. The mounting flange 24 is provided with a plurality of apertures 38 for securement by threaded fasteners to the floor of a public rest room.

Figure 3:
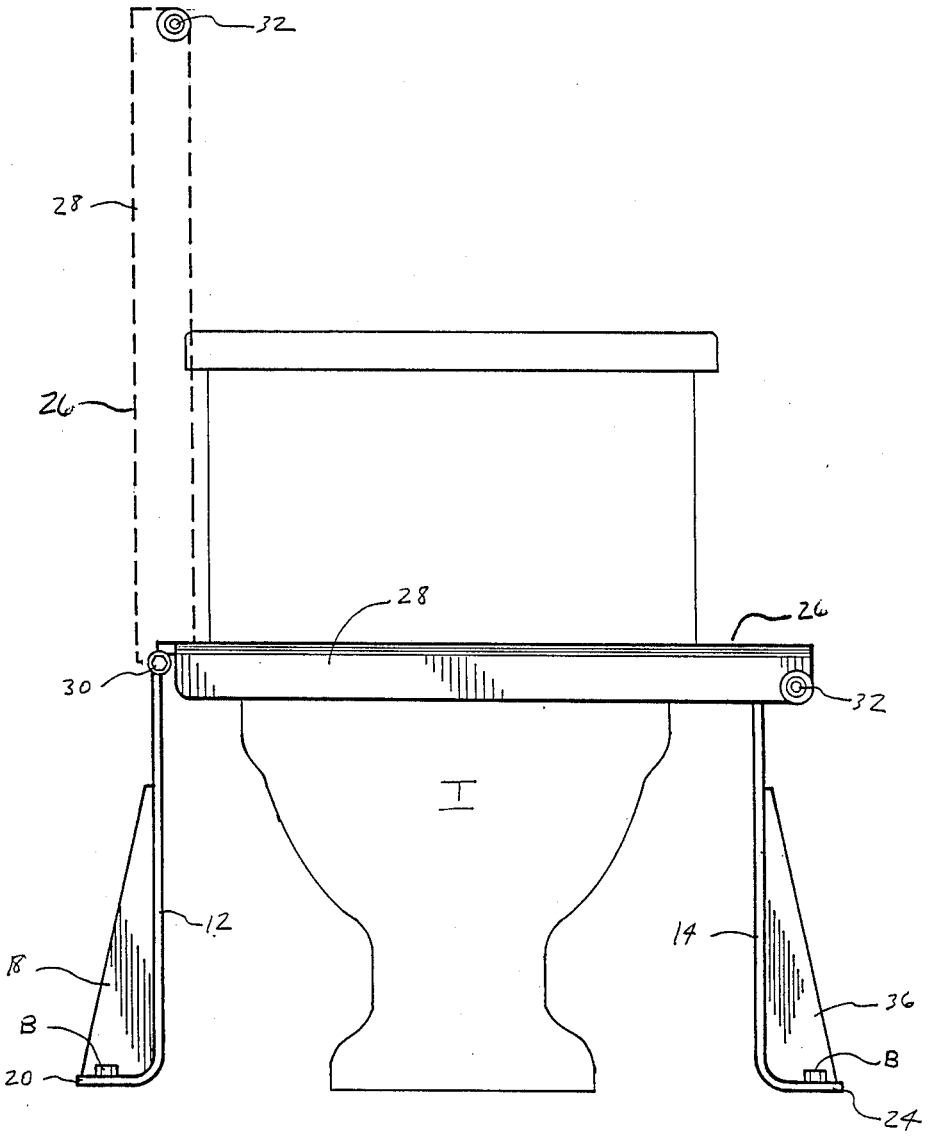
FIG. 3 is a front view of the auxiliary toilet seat according to the first embodiment of the present invention.

In FIG. 3, a front view is provided, which illustrates the auxiliary toilet seat according to the first embodiment of the present invention mounted in an operative position adjacent a conventional toilet T. A plurality of mounting bolts B are utilized to secure the mounting flanges 20 and 24 to the floor of a public rest room, just in front of the toilet T. In use, an individual places the seat 26 in the illustrated horizontal position and backs up to the seat until the front wall 28 contacts the back of their legs. The individual then sits on the bench seat 26 and utilizes the toilet T. By virtue of this arrangement, no portion of the individual's body comes into contact with the public toilet T. Additionally, only the back of the individual's legs come into contact with the seat 26.

This alleviates the possibility of an individual contracting any disease from contact with the public toilet T. When finished, an individual may raise the seat 26 to the vertical position illustrated in dotted lines, for purposes of gaining access for flushing the toilet T. This pivotal construction also enables access to the toilet T for purposes of cleaning and also allows individuals the choice of using the conventional seat of the toilet T or utilizing the auxiliary toilet seat of the present invention.

Figure 4:
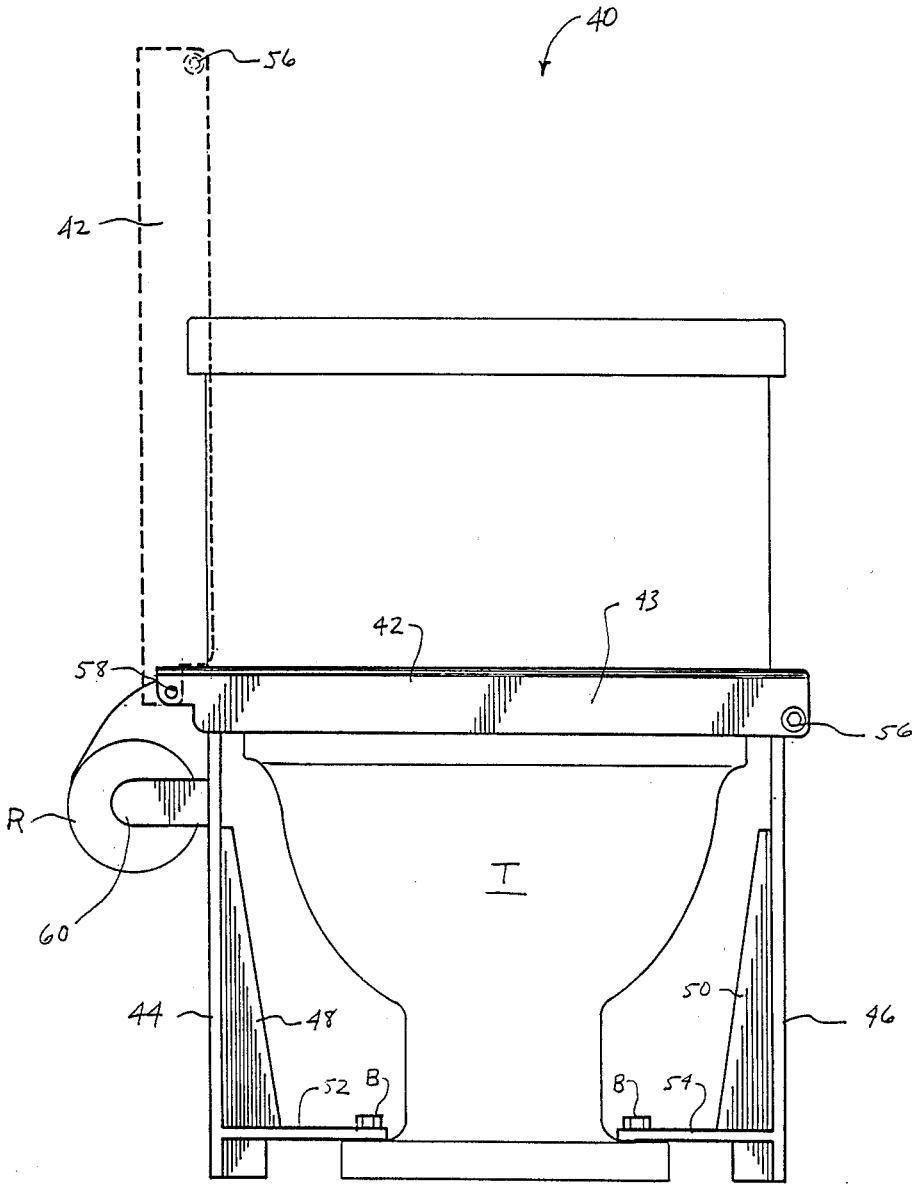
FIG. 4 is a front view of the auxiliary toilet seat according to the second embodiment of the present invention.

With reference now to FIG. 4, a second embodiment 40 of the present invention will now be described. The auxiliary toilet seat 40 according to the second embodiment of the present invention includes a bench type seat 42 having a vertical front wall portion 43. The bench seat 42 is movable from the illustrated horizontal position to a vertical position illustrated in dotted lines. A hinge pin 58 serves to connect one end of the seat 42 to a top portion of a cantilever vertical leg 44. A handle spindle 56 is provided at an opposite end of the seat 42, and allows an individual to pivot the seat 42 by manipulation of an attached handle. A second cantilever vertical leg 46 has a top portion which abuts the bench seat 42. The vertical leg 44 has a generally horizontally extending mounting flange 52 which is secured by conventional bolts B to the base of the toilet T. The other vertical leg 46 has a corresponding horizontal mounting flange 54 which is also secured by bolts B to the base of the toilet T. By virtue of this construction, the auxiliary toilet seat 40 according to the second embodiment of the present invention may be quickly attached to a conventional public toilet T, without the necessity of drilling any additional holes in the floor of the public rest room. The vertical leg 44 has a tissue roll holder 60 which serves to mount a conventional roll R of tissue. The tissue roll R may be utilized to cover the top surface of the seat 42 with new paper, between usage by individuals. The vertical legs 44 and 50 each have a first triangular support rib 48 and 50 Which serves to provide enhanced rigidity.

Figure 5:
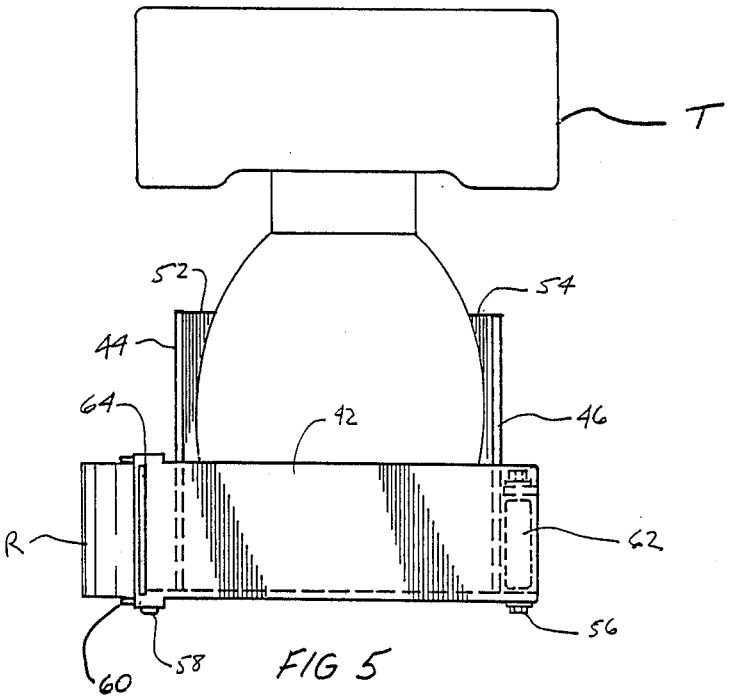
FIG. 5 is a top view of the auxiliary toilet seat according to the second embodiment of the present invention.

As shown in FIG. 5, the legs 44 and 46 are curved forwardly, and serve to provide a cantilever mounting of the seat 42. The mounting flanges 52 and 45 extend inwardly from each of the legs 44 and 46 and are in engagement with the mounting bolts on the base of the toilet T. A handle 62 is mounted by the handle spindle 56 on the underside at one end of the seat 42. Adjacent the opposite end of the seat 42, a slot 64 allows passage of tissue paper from the roll R for purposes of covering the upper surface of the seat 42.

Figure 6:
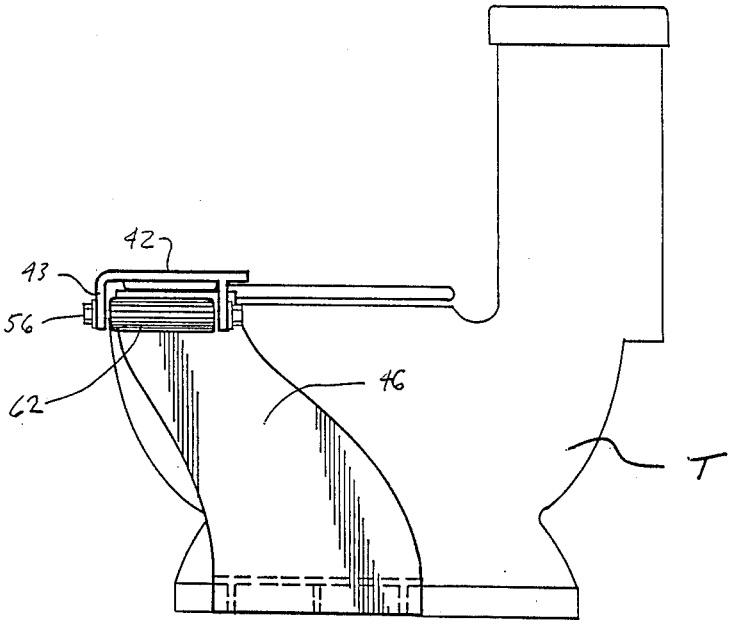
FIG. 6 is a side view of the auxiliary toilet seat according to the second embodiment of the present invention.

In FIG. 6, a side view of the auxiliary toilet seat according to the second embodiment of the present invention illustrates the handle 62 adjacent the underside edge of the seat 42. The cantilever curvature of the leg 46 may now be understood.

Figure 7:
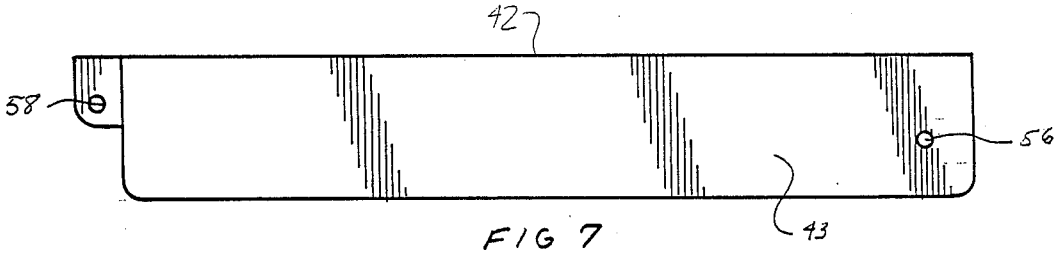
FIG. 7 is a front view of the bench seat portion of the auxiliary toilet seat according to the second embodiment of the present invention.

In FIG. 7, a front view of the seat 42 of the second embodiment of the present invention is provided. The seat 42 has a generally vertically extending front wall 43 provided with an aperture at one end for receiving a hinge pin 58. At an opposite end, another aperture is provided for reception of the handle spindle 56.

Figure 8:
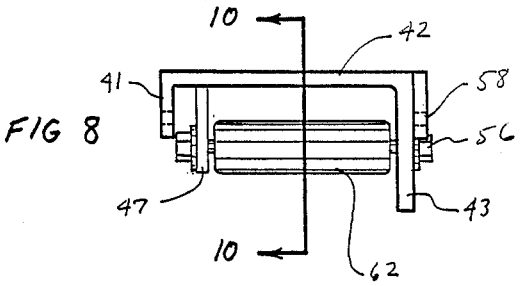
FIG. 8 is an end view of the bench seat portion of the auxiliary toilet seat according to the second embodiment of the present invention.

As shown in the end view of FIG. 8, the seat 42 is provided with a downwardly extending hinged tab 41 which is opposed to the vertical front wall 43. A similar tab 47 is provided at an opposite end of the seat 42 for purposes of mounting the handle spindle 56.

Figure 9:
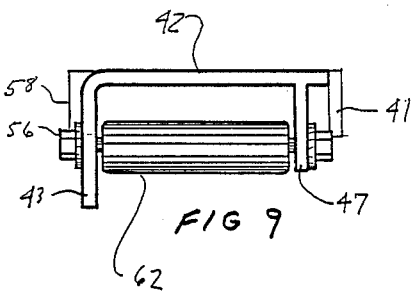
FIG. 9 is an opposite end view of the bench seat portion of the auxiliary toilet seat according to the second embodiment of the present invention.

FIG. 9 provides an opposite end view of the seat 42.

Figure 10:
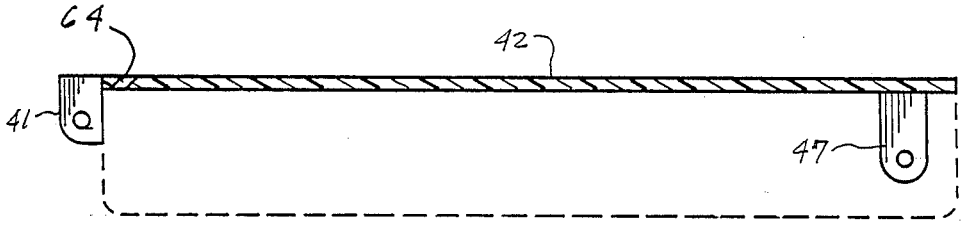
FIG. 10 is a cross sectional view, taken along line 10—10 of FIG. 8, illustrating the bench seat portion of the auxiliary toilet seat according to the second embodiment of the present invention.

As shown in the cross sectional view of FIG. 10, the mounting tabs 41 and 47 extend generally perpendicular to the top portion of the seat 42.

Figure 11:
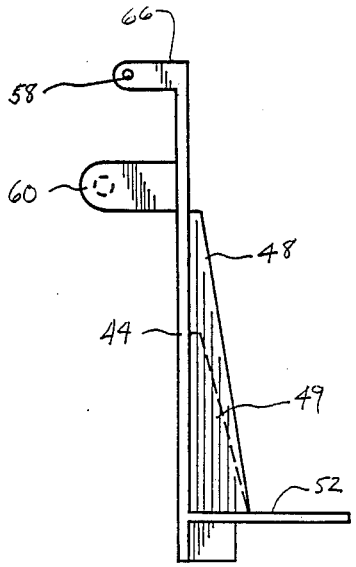
FIG. 11 is a front view of one of the cantilever vertical legs of the auxiliary toilet seat according to the second embodiment of the present invention.

In FIG. 11, a front view of the cantilever support leg 44 is provided. First 48 and second 49 generally triangular support ribs extend along the length of the leg 44, and provide enhanced rigidity to the support leg 44 and to the mounting flange 52. A hinged bracket 66 is transversely formed at the top end portion of the vertical leg 44 for purposes of receiving a hinged pin 58. A conventional tissue paper roll holder 60 extends transversely outwardly from the leg 44, slightly beneath the hinged bracket 66.

Figure 12:
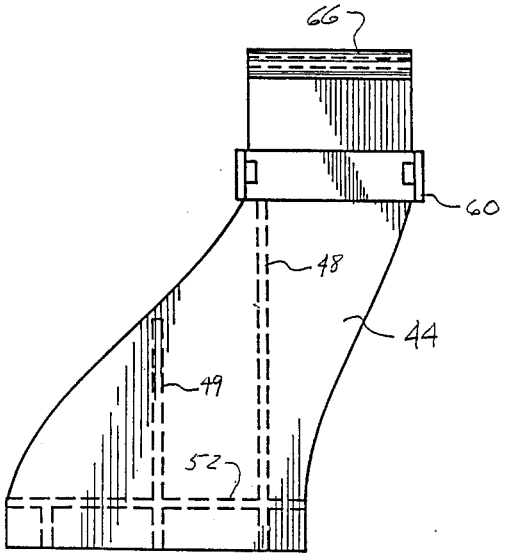
FIG. 12 is a side view of the cantilever vertical leg of FIG. 11.

With reference to the side view of the leg 44 provided in FIG. 12, the relative positions of the various elements may be clearly understood.

The auxiliary toilet seats of the first embodiment 10 and second embodiment 40 of the present invention may be formed from a variety of conventional materials such as metal or plastic. As may now be understood, the auxiliary toilet seat of the present invention may be permanently mounted in a public rest room and allows individuals a choice of usage of the conventional toilet seat or the auxiliary seat of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An auxiliary toilet seat, adapted to be mounted to a toilet secured in a public rest room by floor mounting bolts, said auxiliary toilet seat comprising:

a pair of spaced vertical legs;

each of said legs having a top portion and a bottom portion;

a bench seat having a generally flat top surface and a transverse front wall;

said bench seat having a first end and a second opposite end;

hinge means pivotally connecting said first end of said bench seat to said top portion of one of said legs;

handle means adjacent said second opposite end of said bench seat, whereby said bench seat may be moved between vertical and horizontal positions;

a horizontal mounting flange adjacent said bottom portion of each of said legs;

said mounting flanges extending inwardly, toward said bench seat;

a pair of generally triangular support ribs extending along each of said legs and connected with said mounting flanges;

said vertical legs each having an arcuate forward curvature providing a cantilever support for said bench seat; and a plurality of spaced apertures in each of said mounting flanges for mounting said bench seat with said toilet floor mounting bolts.

2. The auxiliary toilet seat of claim 1, further comprising means mounting a tissue roll on one of said vertical legs.

3. The auxiliary toilet seat of claim 2, further comprising a slot through said bench seat for receiving tissue paper from said roll.

* * * * *